US005702193A

United States Patent [19]

Kageyama et al.

[11] Patent Number: 5,702,193

[45] Date of Patent: Dec. 30, 1997

[54] SIDE KNOCK TYPE MECHANICAL PENCIL

[75] Inventors: Hidehei Kageyama; Tomiji Ueki; Yoshihide Mitsuya, all of Kawagoe, Japan

[73] Assignee: Kotobuki & Co.,Ltd., Kyoto, Japan

[21] Appl. No.: 775,167

[22] Filed: Dec. 31, 1996

Related U.S. Application Data

[62] Division of Ser. No. 327,549, Oct. 24, 1994, abandoned.

[30] Foreign Application Priority Data

Jul. 22, 1994 [JP] Japan ..... 6-191293
Sep. 27, 1994 [JP] Japan ..... 6-267965

[51] Int. Cl.[6] ..... B43K 21/00

[52] U.S. Cl. ..... 401/65

[58] Field of Search ..... 401/49, 55, 65, 401/92

[56] References Cited

U.S. PATENT DOCUMENTS

| | | | |
|---|---|---|---|
| 1,866,072 | 7/1932 | Woelm | 401/65 |
| 3,813,176 | 5/1974 | Kamo . | |
| 3,883,253 | 5/1975 | Naruse et al. . | |
| 3,892,495 | 7/1975 | Naruse et al. | 401/65 |
| 3,945,733 | 3/1976 | Edel | 401/65 X |
| 4,270,870 | 6/1981 | Hashimoto et al. . | |
| 4,955,739 | 9/1990 | Kageyama et al. | 401/65 |
| 5,062,727 | 11/1991 | Kageyama et al. . | |
| 5,236,271 | 8/1993 | Sakaoka | 401/65 |
| 5,354,141 | 10/1994 | Watanabe | 401/65 |

FOREIGN PATENT DOCUMENTS

| | | | |
|---|---|---|---|
| 294823 | 12/1988 | European Pat. Off. | 401/65 |
| 1020256 | 11/1957 | Germany . | |
| 295800 | 12/1990 | Japan | 401/65 |
| 4048000 | 2/1992 | Japan . | |
| 8810198 | 12/1988 | WIPO . | |

*Primary Examiner*—William E. Stoll
*Attorney, Agent, or Firm*—Rothwell, Figg, Ernst & Kurz

[57] ABSTRACT

A side knock type mechanical pencil including a cylindrical shell having a ferrule; a slide member disposed axially movably within the cylindrical shell; a chuck disposed in front of the slide member, with a chuck ring being loosely fitted on the chuck; a chuck spring for urging the chuck backward; and a side knock mechanism provided in the cylindrical shell, the said side knock mechanism comprising a side knock member provided in the cylindrical shell and the slide member, the slide member being movable axially against the backward bias of the chuck spring and having a slant portion for abutment with the side knock member when the side knock member is depressed radially.

12 Claims, 11 Drawing Sheets

SIDE KNOCK TYPE MECHANICAL PENCIL

This is a divisional of application Ser. No. 08/327,549, filed Oct. 24, 1994, now abandoned.

FIELD OF THE INVENTION

The invention relates to side knock-type mechanical pencils and, more particularly, to a side knock-type mechanical pencil provided with a mechanism for the delivery of a rod-like article, e.g., an eraser or the like.

BACKGROUND OF THE INVENTION

Various side knock-type mechanical pencils have been proposed. One example of a conventional side knock-type mechanical pencil is disclosed in U.S. Pat. No. 3,883,253 and is illustrated in FIG. 1. According to this prior art example, a knock lever 22 is mounted within a side hole 21 in a cylindrical shell 20 which houses a chuck mechanism, and a piece of lead is pushed out of the pencil by pressing ("knocking") the knock lever 22 with a finger tip while grasping the pencil in the vicinity of the knock lever. More particularly, upon operation of the knock lever 22, an actuating portion 22*a* thereof comes into abutment with a slanted portion 24*a* of a slider 24 provided on the elongated cylindrical portion 27 of chuck 26, which elongated cylindrical portion is connected to a lead tank 23. This causes the lead tank 23 to move forward inside the cylindrical shell 20 against a backward biasing force of a spring 25, whereby the chuck 26 opens slightly and permits delivery of a piece of lead.

In such a conventional mechanical pencil, the side knock mechanism is generally positioned in the grip portion of the shell 20. Therefore, in the case where a grip member formed of an elastic material such as rubber is formed in that portion, the diameter of the grip portion becomes large, so the diameter of the lead tank 23 is sized to permit one lead piece to pass therethrough, and a space for spare leads is formed in the rear portion of the shell 20.

Recently, however, there has been proposed a mechanical pencil having in the rear portion thereof a mechanism for the delivery of a rod-like article such as an eraser or the like. In a side knock-type mechanical pencil having such a mechanism incorporated therein, there is no space for spare leads in the rear portion thereof. In addition, the diameter of the lead tank 23 is required to be made small, and thus it has been difficult to accommodate spare leads.

SUMMARY OF THE INVENTION

It is an object of the present invention to provide a side knock-type mechanical pencil having sufficient space in the rear portion thereof and permitting the inside diameter of the lead tank to be enlarged to permit a plurality of spare leads to be received therein, and also permitting the provision of a grip member if necessary.

It is another object of the present invention to provide a side knock-type mechanical pencil having a rear-end knock mechanism, in addition to a side knock mechanism, to permit a lead to be advanced easily in the initial, continuous knocking phase.

It is a further object of the present invention to provide a side knock-type mechanical pencil wherein a slide member is formed as a one-piece member having a slanted portion, a large-diameter portion, and a lead passageway extending through the slanted portion and the large-diameter portion, thereby reducing the number of components and the cost and facilitating assembly of the pencil.

According to the present invention, in order to achieve the above-mentioned objects, there is provided a side knock-type mechanical pencil having a cylindrical shell with a ferrule; a lead tank disposed axially slidably within the cylindrical shell; a chuck disposed at the front end portion of the lead tank, with a chuck ring loosely fitted on the chuck; a resilient member for urging the chuck backward; and a side knock mechanism provided in the cylindrical shell. The side knock mechanism includes a side knock member provided in the cylindrical shell and a slide member, the slide member having a lead-inserting hole formed axially therethrough and a slant portion for abutment with the side knock member. The slide member is movable axially against the backward biasing force of the resilient member.

Furthermore, according to the present invention, in order to achieve the above-mentioned objects, there is provided a side knock-type mechanical pencil having a cylindrical shell with a ferrule; a slide member disposed axially slidably within the cylindrical shell; a chuck disposed at the front end portion of the slide member, with a chuck ring loosely fitted on the chuck; a resilient member for urging the chuck backward; and a side knock mechanism provided in the cylindrical shell. The side knock mechanism includes a side knock member provided in the cylindrical shell and the slide member, the slide member being movable axially against the backward biasing force of the resilient member and having a slant portion for abutment with the side knock member and a lead-inserting hold formed axially therethrough.

By depressing a knock lever as the side knock member, the slide member is moved forward against the backward bias of the resilient member to open the chuck and push out a lead. Where required, a rod-like article such as an eraser or the like can be pushed out backward by rotating a rear cap. Furthermore, when continuous knocking is required, the read end of the mechanical pencil can be knocked, whereby a lead can be pushed out.

DETAILED DESCRIPTION OF THE PREFERRED EMBODIMENTS

Figure 1:
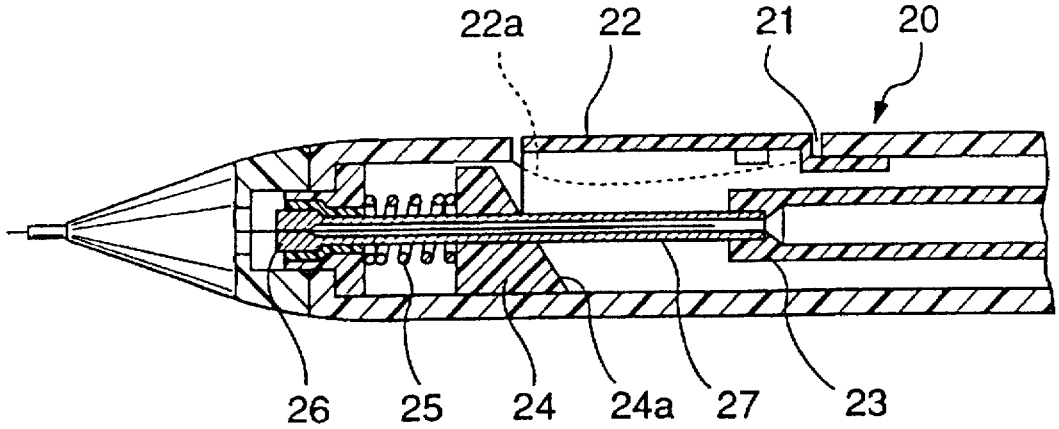
FIG.1 PRIOR ART
FIG. 1 is a section view of a conventional side knock-type mechanical pencil.

Embodiments of the present invention will now be described in detail with reference to the accompanying drawings.

FIGS. 2 to 14B illustrate a mechanical pencil according to one embodiment of the present invention, in which knocking operation is performed by side knock and rear-end knock features. In this embodiment, a writing mechanism is provided in the front portion of the interior of a cylindrical shell 1, and an eraser delivery mechanism is provided in the rear portion of the cylindrical shell.

Reference will first be made to the writing mechanism. Within the cylindrical shell 1 there is disposed a coupling 2 which is axially slidable. The coupling 2 couples a chuck 3 and a lead tank and has an inside diameter sufficient to receive therein a plurality of leads arranged together. A chuck 3 is press-fitted and fixed into the front end of the coupling 2, and a chuck ring 4 is loosely fitted on the chuck 3. A sleeve 5 is provided outside the chuck 3, and a chuck spring 6 is mounted inside the sleeve 5 for urging the coupling 2 backward.

A ferrule 7, which has on its inner periphery a circumferential stepped portion 7*a* that serves as a stopper for the chuck ring 4, is threadedly engaged with the front end of the cylindrical shell 1. An axially slidable tip pipe 8, and a slider 9 into which the rear end of the tip pipe 8 is press-fitted and fixed, are disposed within the ferrule 7. The inner peripheral portion of the slider supports a lead piece by virtue of frictional resistance. A cushion spring 10, which absorbs excessive writing pressure, is mounted between the rear end of the sleeve 5 and a shoulder la formed on the inside surface of the cylindrical shell 1.

Reference numeral 10*a* denotes a return spring mounted between the shoulder 1*a* and the front end of a slide member 17, which will be described below. The return spring 10*a*, which has a biasing force weaker than that of the chuck spring 6 and urges the slider 17, etc., backward, is advantageous in the following point. If the rear end of the coupling 2 is in abutment with a stepped portion of the front inner periphery of the slide member 17, there is created a knocking state and the chucking portion at the front end of the chuck 3 is open slightly, thus causing lead slippage. Therefore, it is necessary to keep the rear end of the coupling 2 slightly spaced from the stepped portion of the front inner periphery of the slide member 17 in order to avoid mutual abutment. In the presence of such a gap, however, it is likely that the slide member 17 will move back and forth by a distance corresponding to the gap. However, since the return spring 10*a* urges the slide member 17 continually backward, there is no fear of such longitudinal sliding (wobbling) of the slide member 17.

Figure 4:
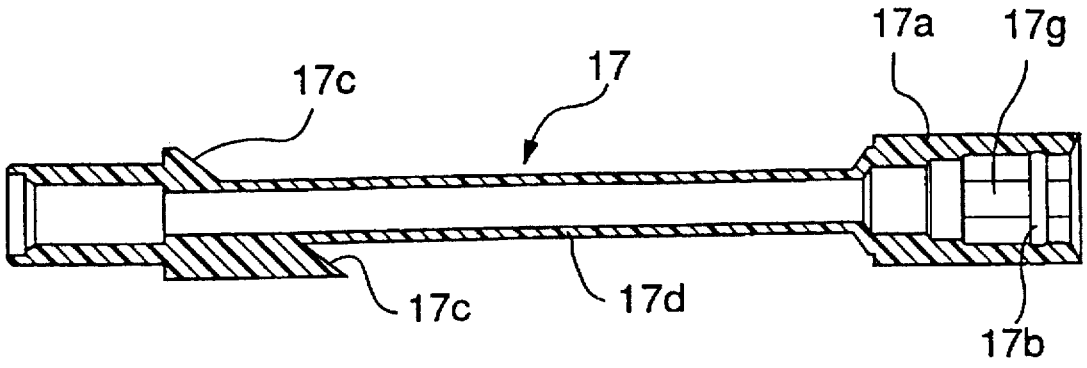
FIG. 4 is a section view of the slide member illustrated in FIG. 3.
Figure 5:
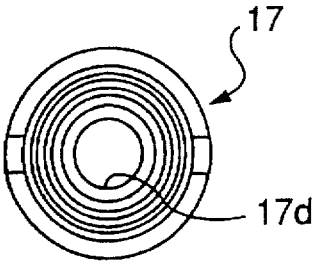
FIG. 5 is an end view of the slide member illustrated in FIGS. 3 and 4.
Figure 6:
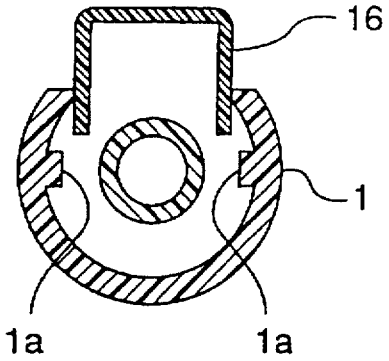
FIG. 6 is a section view taken along line A—A in FIG. 2.
Figure 7:
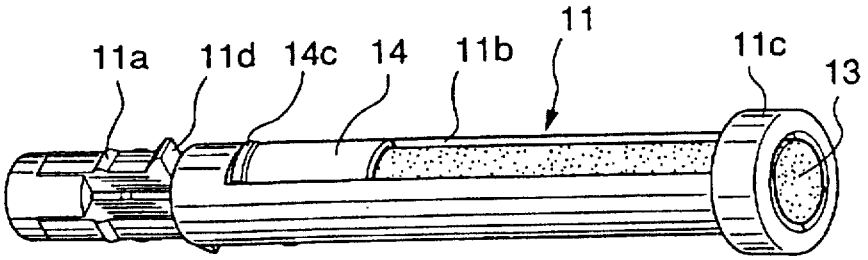
FIG. 7 is a perspective view of a guide cylinder illustrated in FIG. 2, with an eraser and an eraser support member inserted therein.
Figure 8:
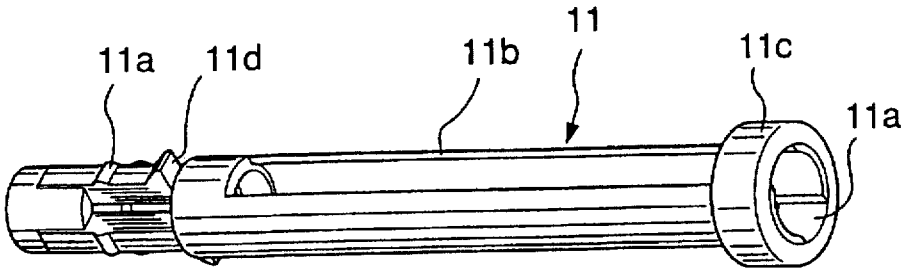
FIG. 8 is a perspective view of the guide cylinder illustrated in FIG. 7.
Figure 9:
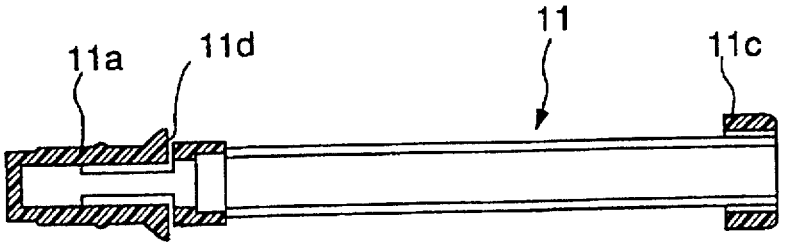
FIG. 9 is a longitudinal section view of the guide cylinder illustrated in FIGS. 7 and 8.

The description is now directed to the eraser delivery mechanism located at the rear portion of the cylindrical shell 1. A guide cylinder 11, shown in FIGS. 7 to 9, is extractally fitted in a receptacle portion 17*a*, of a larger diameter than the guide cylinder, which is formed at the rear portion of the slide member 17 as shown in FIG. 4. More specifically, an annular groove 17*b* is formed in the inner periphery of the receptacle portion 17*a*, and a ring-like protuberance 11a is formed on the outer periphery of the guide cylinder 11 for engagement with the annular groove 17*b*.

The guide cylinder 11 has a pair of axially extending slits 11*b* formed opposite to each other. The slits 11*b* are closed at their rear ends, at which there is formed a large-diameter annular portion 11*c*. The guide cylinder 11 is inserted axially slidably into a rotatably connected rear cap 12 and is engaged circumferentially with the rear cap, with its rear end projecting beyond the rear end of the cap 12.

At the front portion of the guide cylinder 11 there are integrally formed a pair of flexible retaining lugs 11*d* which engage the front of the rear cap 12 to provide an axial lock. When the guide cylinder 11 is inserted into the rear cap 12, the flexible retaining lugs 11*d* bend inwards and then revert to their original state as they pass through the rear cap 12. Thereafter, the guide cylinder 11 and the rear cap 12 are rotatable relative to the shell 1 but are locked axially and are prevented from falling out of the shell.

Figure 11:
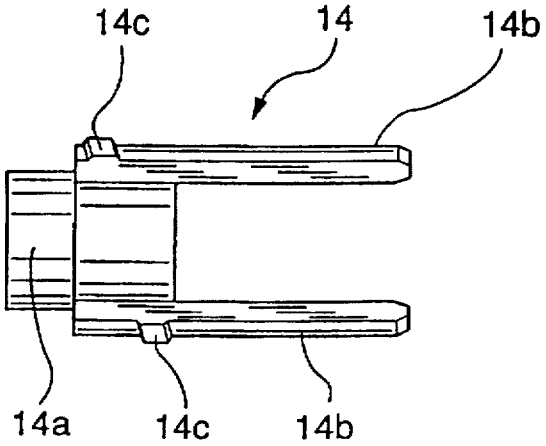
FIG. 11 is a side view of the eraser support member illustrated in FIG. 10.
Figure 12:
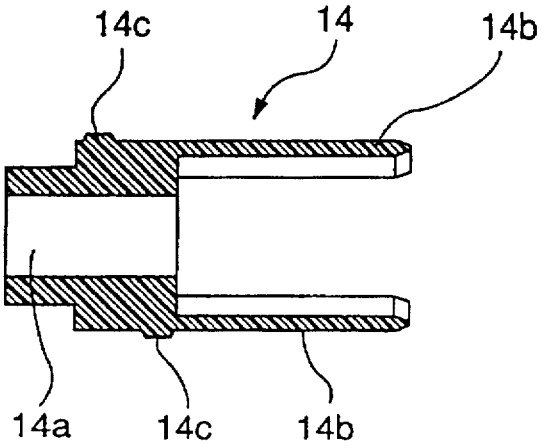
FIG. 12 is a longitudinal section view of the eraser support member illustrated in FIG. 10.
Figure 10:
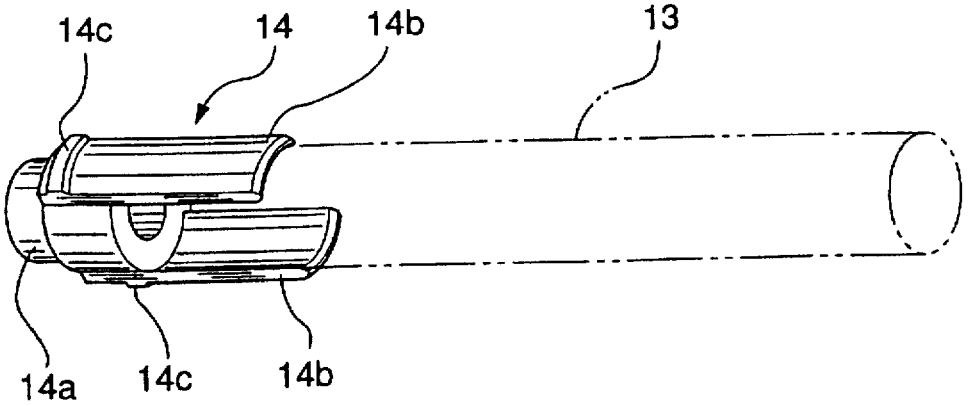
FIG. 10 is a perspective view of the eraser support member illustrated in FIG. 7.

An eraser support member 14, which supports an eraser 13, is inserted axially slidably into the guide cylinder 11 and is engaged circumferentially with the guide cylinder. As shown in FIGS. 10 to 12, the eraser support member 14 is provided with a cylindrical body 14*a*, a pair of opposed arm portions 14*b* extending backward from the cylindrical body 14*a*, and a pair of inclined lugs 14*c* formed on the outer surfaces of the arm portions 14*b*. The inclined lugs 14*c* extend through the slits 11*b* formed axially in the guide cylinder 11 and engage a spiral groove 12*a* formed in the inner periphery of the rear cap 12.

Figure 2:
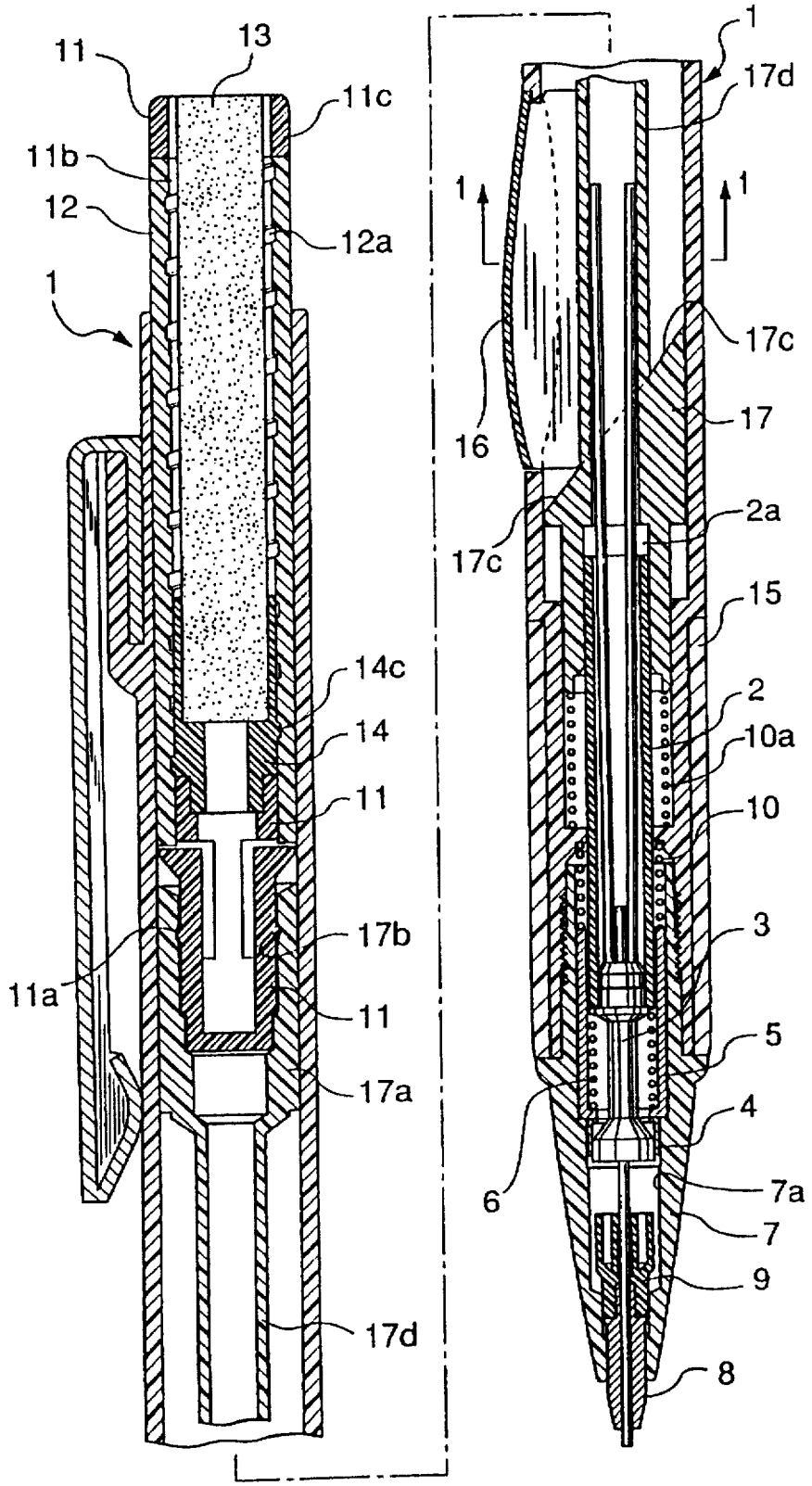
FIG. 2 is a longitudinal section view of a side knock-type mechanical pencil according to one embodiment of the present invention.
Figure 3:
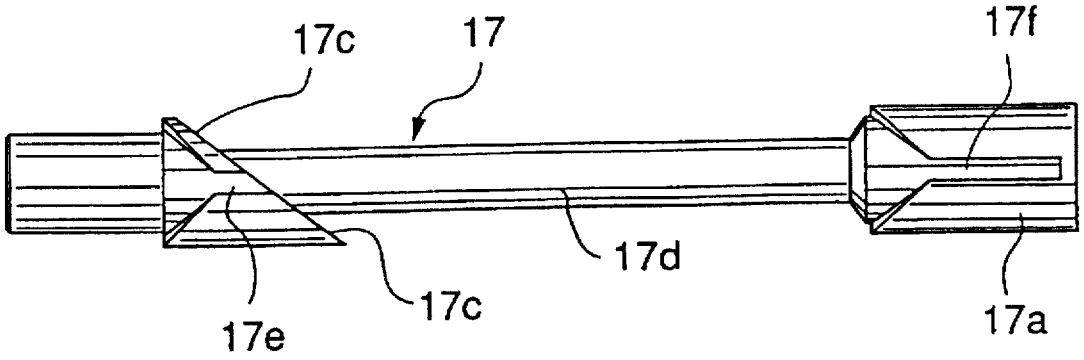
FIG. 3 is a side view of a slide member illustrated in FIG. 2.

As shown in FIG. 2, a grip member 15 formed of, e.g., rubber, is mounted onto a grip portion of the cylindrical shell 1. A side knock lever 16 is arranged behind the grip member 15. The knock lever 16 is mounted in a side wall portion of the cylindrical shell 1 so that it can be pushed transverse to the slide member 17. The inside edge of the front end of the knock lever 16 abuts a slanted surface 17*c* of the slide member 17. More specifically, the slide member 17 has the configuration shown in FIGS. 3 and 4. In the illustrated embodiment, the slide member 17 includes a lead passageway 17*d* which receives therein two or more leads at a time each on the order of 0.5 mm in diameter, for example. The slide member 17 further includes a large-diameter portion that has the slanted surface 17*c* in position to oppose the knock lever 16 when the slide member 17 is positioned in the mechanical pencil.

The slanted surface 17*c* slopes away from the knock lever 16 from the front of the large-diameter portion toward the rear. When the knock lever 16 is depressed and comes into abutment with the slanted surface 17*c*, the slide member 17 moves forward. In the side faces of the large-diameter portion of the slide member 17, engaging grooves 17*e* are provided to guide the slide member 17 over ribs 1*a* formed on the inner periphery of the cylindrical shell (FIG. 6), and in the side faces of the receptacle portion 17*a* at the rear of the slide member, engaging grooves 17*f* are formed to fit over the ends of the ribs and provide a stop to limit forward movement of the slide member 17. As shown in FIG. 4, the rear receptacle, portion 17*a* has a polygonal receptacle 17*g* which is, for example, octagonal in cross section and which engages a substantially polygonal end portion of the guide cylinder 11 to link the slide member 17 and the guide cylinder 11.

Thus, with the first embodiment, both side knock and rear knock operation are possible because the front, writing mechanism and rear, eraser-delivery mechanism are connected to each other. Moreover, by rotating the end cap 12 relative to the guide cylinder 11, the eraser 13 is caused to advance out of the end of the pencil. In this regard, because the polygonal end of the guide cylinder 11 fits within the polygonal receptacle in the end of the slide member, and the grooves 17*e* and 17*f* fit over the ribs 1*a*, the guide cylinder 11 is prevented from rotating idly with the end cap 12 as the end cap is rotated to advance the eraser.

Furthermore, the rear knock capability makes it easier to advance a lead from the lead tank and the coupling 2 to the retractable tip pipe 8 to initiate writing with a new piece of lead. This is because side knocking, which is typically used while actually writing, is performed with the pencil held relatively horizontally so that the lead does not advance forward easily or quickly. With rear knocking, in contrast, the pencil is generally held vertically (and the end pressed with the thumb of the hand holding the pencil) so that the lead drops down from the lead tank more easily. Additionally, it is generally easier to perform the continuous, repeated knocking required to advance a new lead with the thumb, by rear knocking, than with the finger, by side knocking.

Figure 13A:
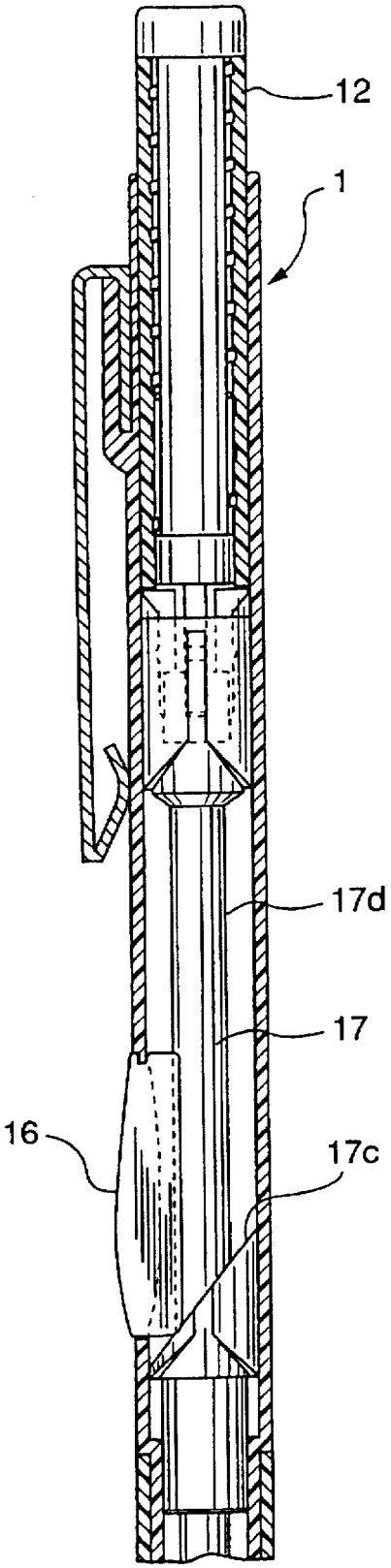
FIGS. 13A and 13B are longitudinal section views, showing side knock operation in the first embodiment.
Figure 13B:
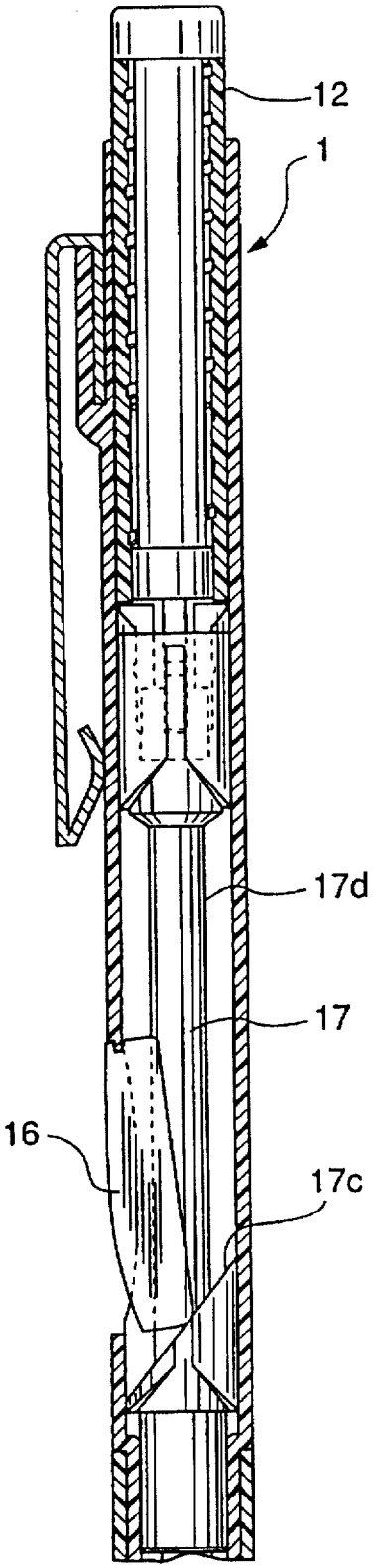

The operation of the first embodiment, constructed as described above, will now be described in detail with reference to FIGS. 13A and 13B. FIG. 13A shows the state of the pencil before knocking. When the side knock lever 16 is depressed for delivery of a lead as shown in FIG. 13B, the inner corner portions of the front end of the knock lever 16 slide along the slanted surface 17*c* of the slide member 17, thereby pushing the slide member forward. As a result, the coupling 2 and the chuck 3 are moved forward against the biasing force of the chuck spring 6. In the course of this forward movement, the chuck ring 4, which is loosely fitted on the chuck 3, comes into abutment with the stepped portion 7*a* of the inner periphery of the ferrule 7 and the chuck 3 extends forward from the chuck ring 4. The slider 9, and hence the tip pipe 8, is moved forward by the chuck 3, which loosens its grip on the piece of lead when it extends forward from the chuck ring 4. Friction between the inner surface of the slider and the piece of lead pulls the lead forward as the slider is pressed forward by the chuck 3.

Upon release of the knock, the slide member 17 is returned to its original position by the chuck spring 6. Furthermore, as the slide member 17 returns to its original position, the chuck 3 also retracts into the chuck ring 4. As it does so, it regains its grip on the piece of lead, thereby pulling the lead, and hence the slider 9 and tip pipe 8, back slightly such that they are positioned to advance the lead once again upon subsequent knocking. Thus, by repeating this knocking operation, the lead is pushed out to permit writing. After writing, by pushing the pencil tip lightly against the paper surface or pushing it lightly with a finger tip and simultaneously pressing the knock lever 16, the chuck 3 is released and the lead and the tip pipe 8 are received back into the ferrule 7.

The rear-end knock operation in this embodiment will now be described. When the rear end of the mechanical pencil is pressed with the pencil held perpendicular to the paper surface, the eraser delivery mechanism is moved forward through the cylindrical shell 1 against the biasing force of the chuck spring 6. As a result, the components connected to this mechanism, i.e., the slide member 17, lead tank, coupling 2, and chuck 3 are advanced, whereby a lead is pushed out in the same manner as in the side knock operation.

Figure 14A:
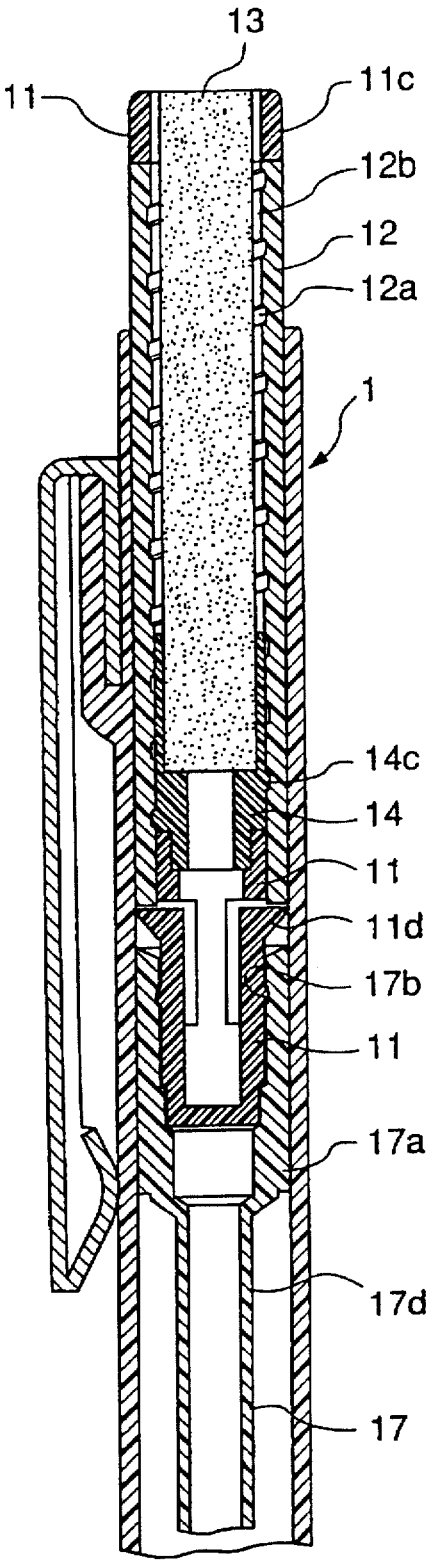
FIGS. 14A and 14B are longitudinal section views, showing eraser delivery in the first embodiment.
Figure 14B:
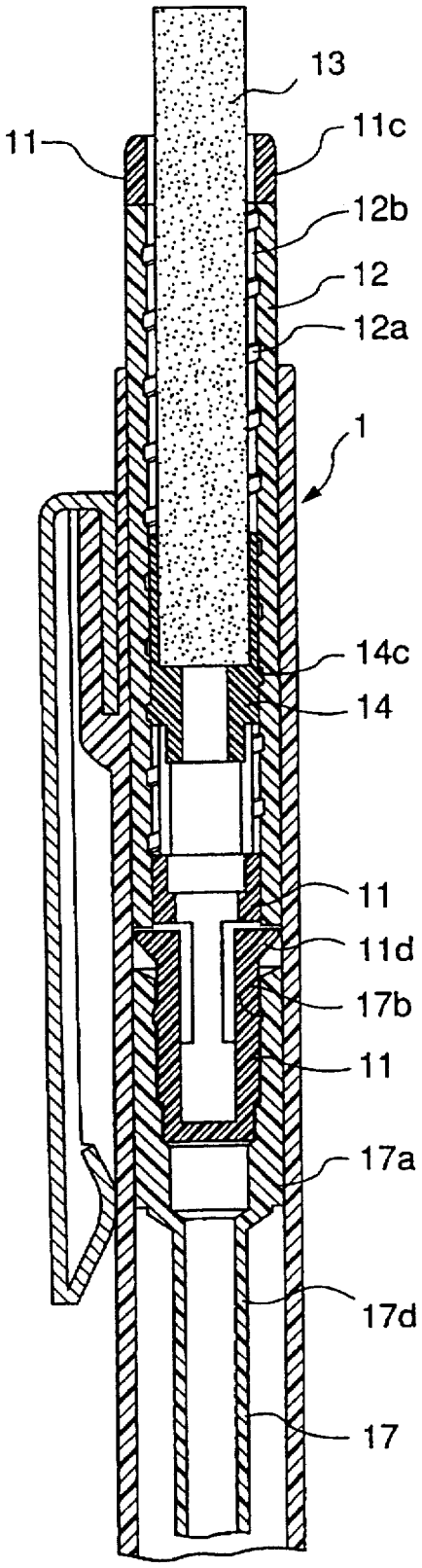

To advance the eraser, as shown in FIGS. 14A and 14B, the rear cap 12 is rotated while the cylindrical shell 1 of the mechanical pencil body is held fixed, thereby causing the eraser support 14 to move up through the guide cylinder 11. This is because the inclined lugs 14*c* of the eraser support member 14 are prevented from rotating by the slits 11*b* of the guide cylinder 11. The guide cylinder 11, in turn is rotationally fixed to the slide member 17 which, in turn, is rotationally fixed to the cylindrical shell 1 by means of ribs 1*a* and grooves 17*e* and 17*f*. Therefore, rotation of the rear cap 12 relative to the guide cylinder 11 causes the inclined lugs 14*c* of the eraser support member 14 to move axially upward along the slits 11*b* in the guide cylinder 11, by means of the spiral groove 12*a* formed in the inner periphery of the rear cap 12, whereby the eraser support member 14 and the eraser 13 advance rearward as shown in FIG. 14B.

When spare leads are to be added to the lead supply tank,the entire eraser delivery mechanism can be removed, as an independent unit, by grasping and pulling the rear cap 12 to disengage the ring-like protrubance 11*a*, on the end of the guide cylinder 11, from the annular groove 17*b* in the inner periphery of the receptacle portion 17*a* of the slide member 17. Thus, a plurality of leads can be loaded into the lead tank at a single time through the receptacle portion 17*a* of the slide member 17.

Figure 16:
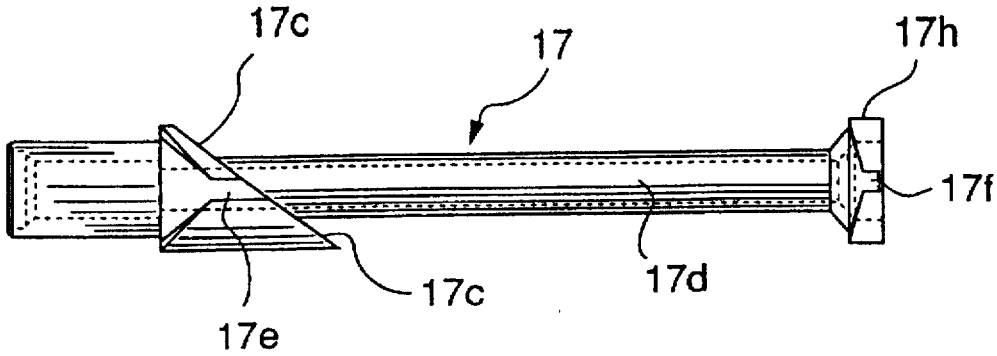
FIG. 16 is a side view of the slide member illustrated in FIG. 15.
Figure 15:
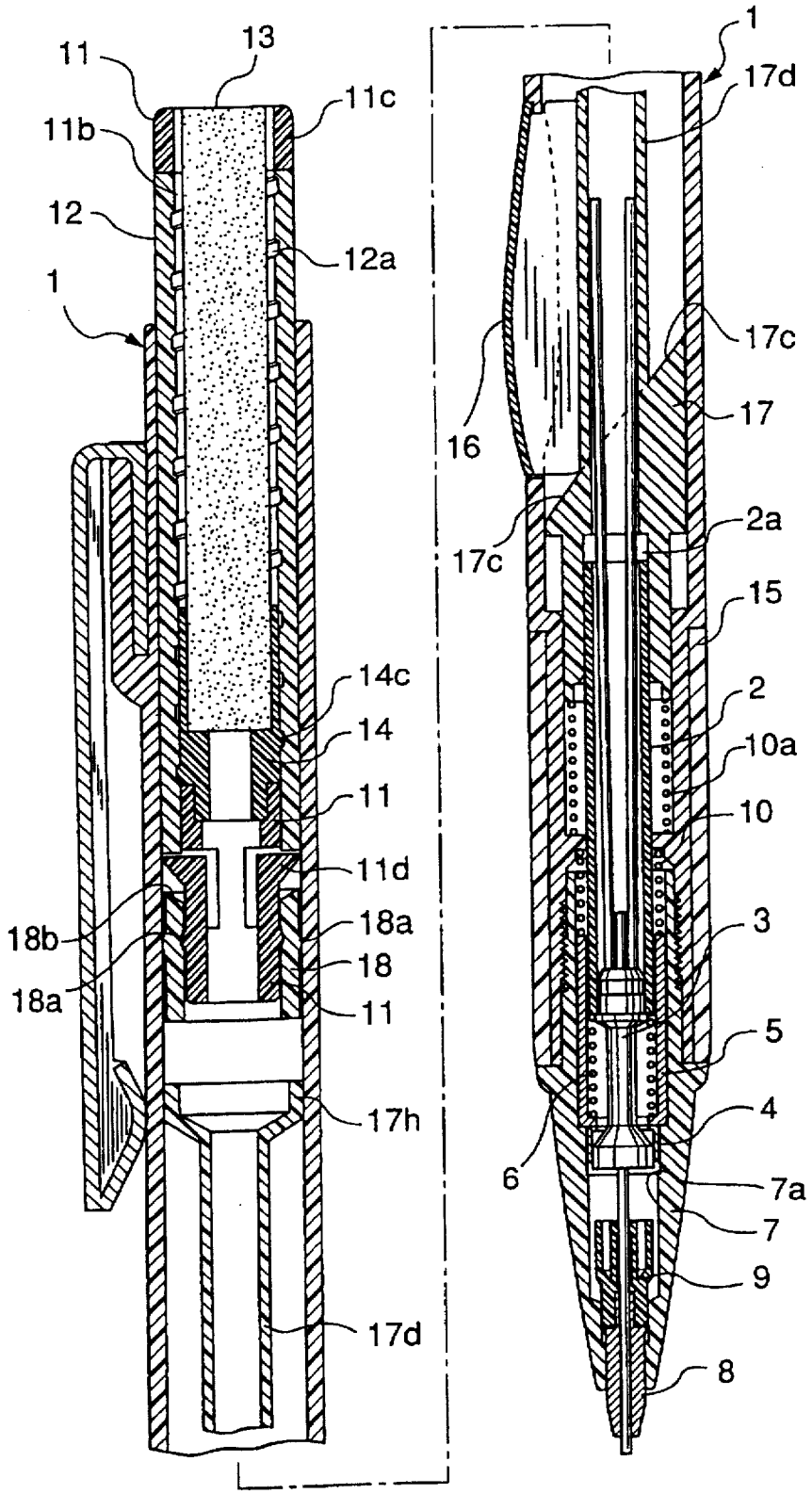
FIG. 15 is a longitudinal section view of a side knock-type mechanical pencil according to a second embodiment of the present invention.

Referring now to FIGS. 15 and 16, there is illustrated a second embodiment of the present invention. In this embodiment, tip pipe 8 and a piece of lead can be advanced outward only by side knock operation. This is because, the slide member 17' and the eraser delivery mechanism at the rear of the pencil are structurally separated from each other, whereby the writing mechanism at the front of the pencil and the eraser delivery mechanism at the rear of the pencil are functionally independent of each other.

More specifically, as shown in FIG. 16, a guide portion 17*h*, which has an outer diameter substantially equal to the diameter of the bore of the shell 1, serves as guide means for the replenishment of new leads and is integrally formed at the rear end of the slide member 17' Rearwardly spaced from the guide portion 17*h*, a receiving sleeve 18 is press-fitted into and firmly secured in place in the cylindrical shell 1 (FIG. 15). The outer periphery of the receiving sleeve 18 has an annular projection 18*a*, which has an upright portion at the rear end and a slanted portion which tapers toward the front of the receiving sleeve. Therefore, when the receiving sleeve 18 is forced into the cylindrical shell 1 from the rear end, e.g., using a jig, the annular projection 18*a* collapses and the receiving sleeve 18 becomes firmly fixed in position within the cylindrical shell.

The end of a guide cylinder 11 is extractably engaged in the receiving sleeve 18, the rear end 18*b* of which is formed in the shape of a funnel to facilitate insertion of a lead. The eraser delivery mechanism is otherwise the same as in the previous embodiment. To replenish leads according to this embodiment, the eraser delivery mechanism is pulled out by grasping the large-diameter portion 11*c* or the rear cap 12 which is exposed at the rear of the guide cylinder 11, and the whole eraser delivery mechanism is withdrawn from the receiving sleeve 18.

Because in this embodiment the writing mechanism and the eraser delivery mechanism are functionally independent of each other, it is not necessary to take as much care as in the first embodiment to prevent rotating motion at the rear of the pencil from being transmitted to the front of the pencil. Furthermore, because the eraser delivery mechanism is securely held by the receiving sleeve 18 which is firmly secured in the cylinder shell 1 (as opposed to being held by the receptacle portion of the slide member), there is no concern that erasing pressure will be transmitted to the writing mechanism, thereby causing a lead to be pushed out unnecessarily and the eraser to retract slightly.

Furthermore, because the slide member 17 used in the second embodiment has engaging grooves 17*e* and 17*f* as shown in FIG. 16, and engaging ribs 1*a* (FIG. 6) are formed in the inner periphery of the cylinder shell 1 corresponding to those grooves, the slide member 17 is prevented from rotation with respect to the cylindrical shell 1. The slide member 17 has a slanted surface 17*c* positioned to oppose a side knock member 16 provided in the cylindrical shell 1 when the slide member is properly positioned in the cylindrical shell. In assembly, therefore, by inserting the slide member 17 into the cylindrical shell 1 and aligning the engaging grooves 17*e* and 17*f* with the engaging ribs 1*a* of the cylindrical shell, the slide member can be positioned accurately. Additionally, one of the engaging grooves 17*e* and 17*f'* may be omitted if only the rotation-preventing or the positioning function is desired. Alternatively, engaging lugs (not shown) can be formed on the side of the slide member 17 instead of the engaging grooves 17*e* and 17*f'*, and corresponding engaging grooves (not shown) can be formed in the inner periphery of the cylindrical shell 1, thereby achieving the same positioning and security result as above.

Figure 17:
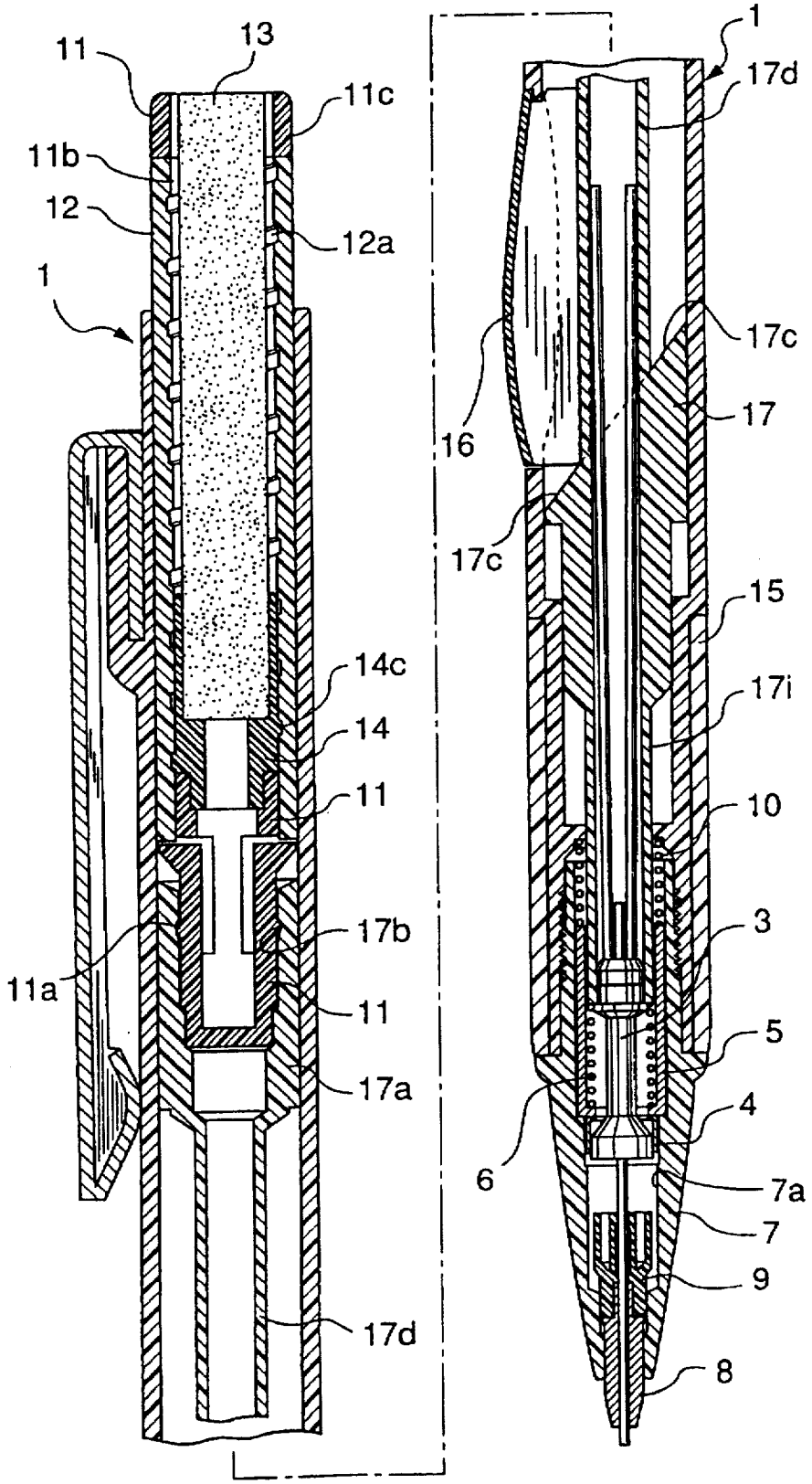
FIG. 17 is a longitudinal section view of a side knock-type mechanical pencil according to a third embodiment of the present invention.

Referring now to FIG. 17, there is illustrated a third embodiment of the present invention. In this embodiment, both side knocking and rear-end knocking are possible, and a one-piece slide member 17" is used. The slide member 17" comprises a receptacle portion 17*a* located at the rear, an intermediate pipe 17*d* extending between the receptacle portion 17*a* and a slant portion 17*c* located at the front, and an extension 17*i* extending forward from the slant portion 17*c*. A chuck 3 is press-fitted directly into the front end of the extension 17*i*. In this case, the return spring 10*a* used in the two previously described embodiments may be omitted.

Figure 18:
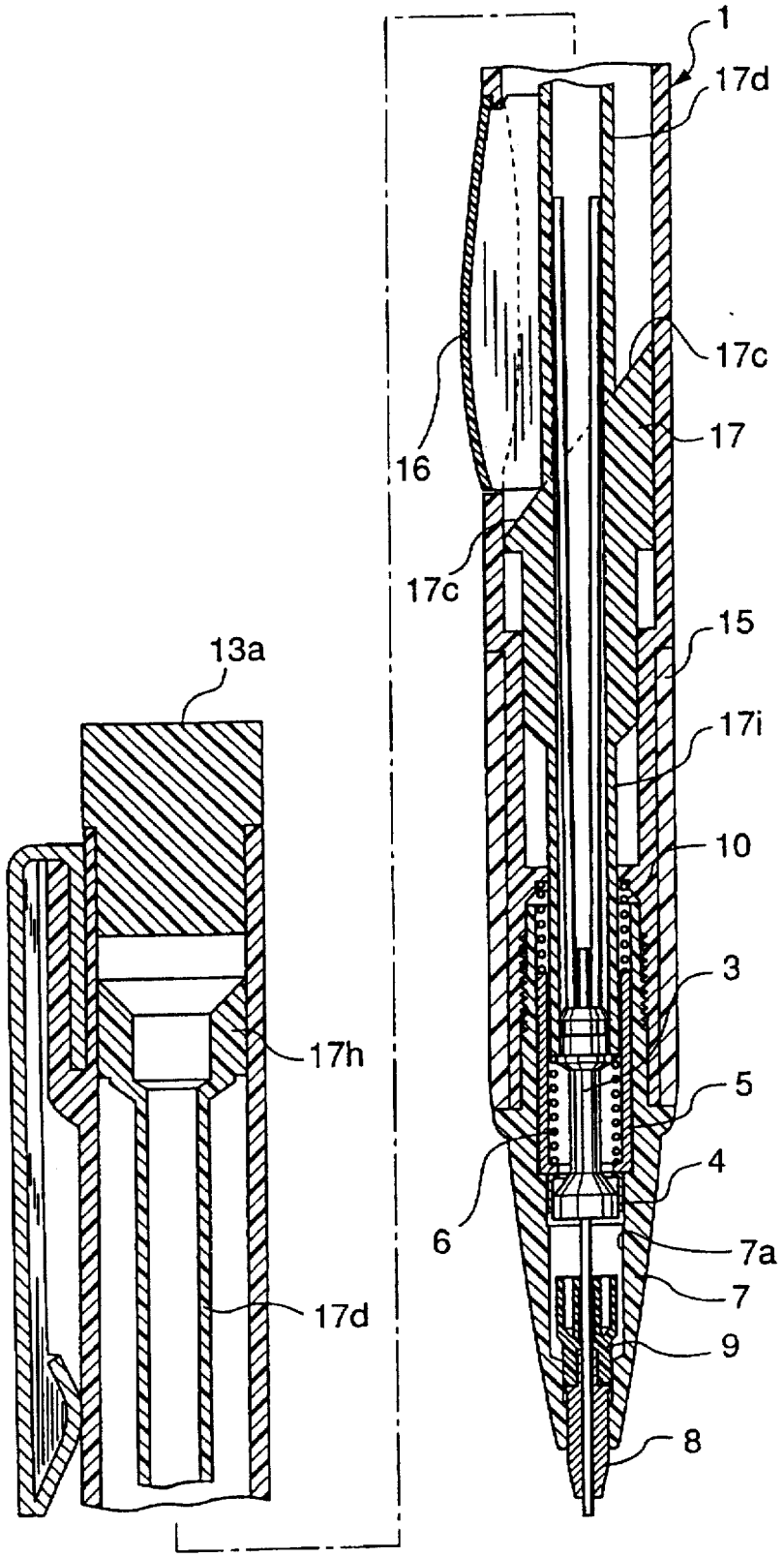
FIG. 18 is a longitudinal section view of a side knock-type mechanical pencil according to a fourth embodiment of the present invention.
Figure 19:
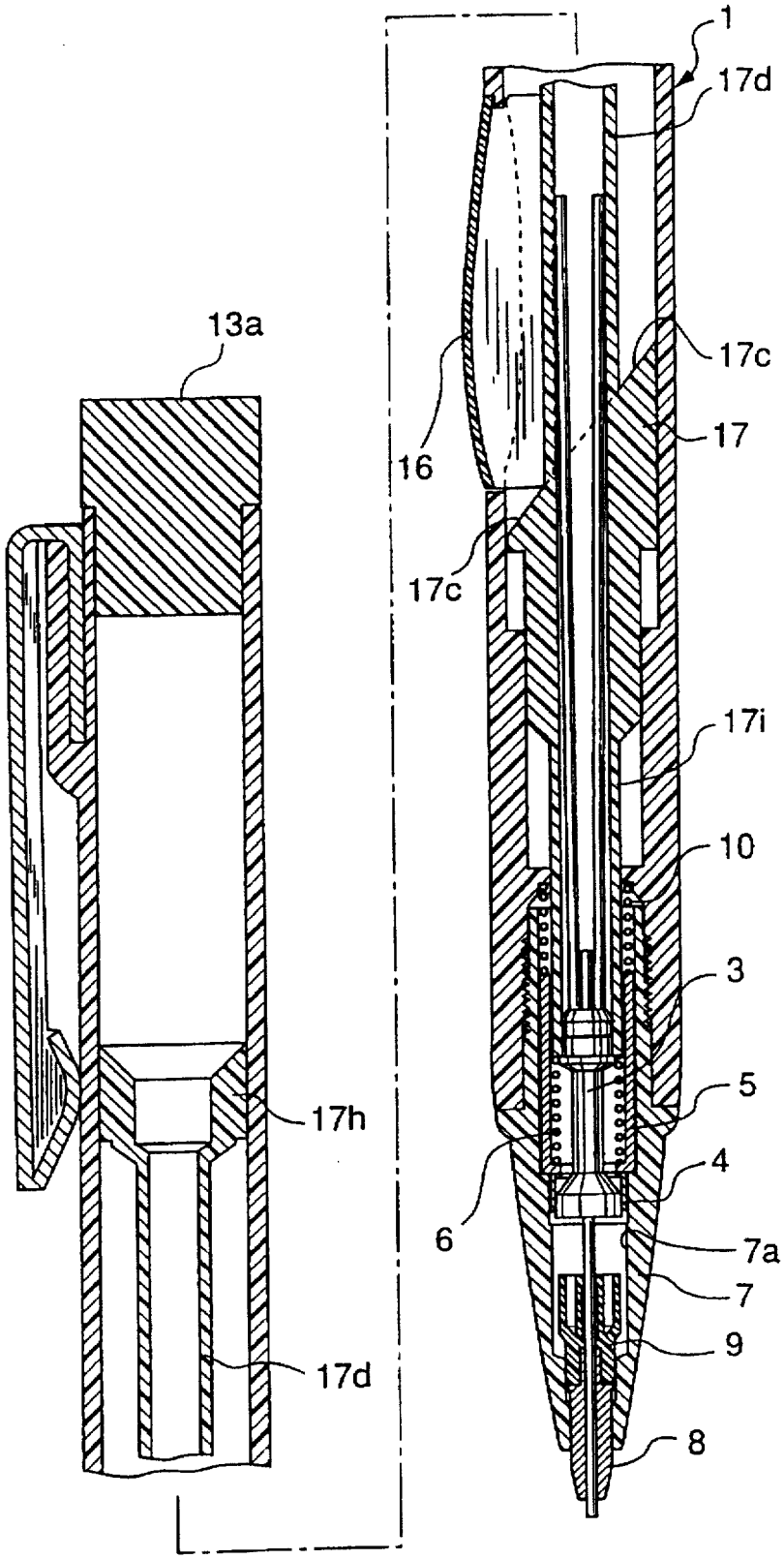
FIG. 19 is a longitudinal section view of a side knock-type mechanical pencil according to a fifth embodiment of the present invention.

Referring now to FIG. 18, there is illustrated a fourth embodiment of the present invention. In this embodiment, in which only side knock operation is possible, the rear end portion of the slide member 17'" is short, and an eraser delivery mechanism is not used. Rather, an eraser/cap 13*a* is used. Because the entire mechanical pencil can be made fairly short, it is possible to obtain a mini-mechanical pencil. Referring further to FIG. 19, there is illustrated a fifth embodiment of the present invention. In this embodiment, only side knock operation is possible, as in the second and fourth embodiments. In addition, the grip member used in all of the previous embodiments is omitted to minimize the number of components used.

Since the present invention is constructed as above, sufficient space is ensured at the rear of a side knock-type mechanical pencil, and it is possible to enlarge the inside diameter of the lead tank and the slide member (which are limited in length) to permit spare leads to be received therein. It is also possible to provide a grip member. Moreover, there may be obtained a mechanical pencil having not only side knock capability, but also rear-end knock capability so that a lead can be advanced easily, even during initial, continuous knocking. Further, there is provided a side knock type mechanical pencil which has a reduced number of components and which is generally less expensive and easier to assemble than other mechanical pencils due to the use of a one-piece slide member.

We claim:

1. A side-knock mechanical pencil comprising:

a generally cylindrical, hollow shell extending from approximately the front end of the pencil to the rear end of the pencil;

chuck means disposed within said cylindrical shell near the front end thereof to advance a pencil lead out of the front end of the pencil upon side-knock operation;

a generally elongated slide member disposed within said shell and connected at a front end thereof to said chuck means, said slide member being axially movable within said shell relative to said shell and formed as a one-piece molded member, said slide member comprising a slanted portion having a surface that is angled relative to a longitudinal axis of said slide member, a lead passageway extending through said slanted portion, and a large-diameter portion at a rear end of said slide member, said large-diameter portion having an outer diameter substantially equal to the inner diameter of said shell;

means for preventing rotational movement of said slide member relative to said shell;

a first biasing member disposed within said cylindrical shell to bias an assembly comprising said chuck means and said slide member backward; and a knock lever disposed within a side of said shell in position to abut said angled surface of said slide member so that when said knock lever is pressed, side-knock operation is effected against the biasing action of said first biasing member.

2. The mechanical pencil of claim 1, wherein the large-diameter portion of said slide member comprises guide means for receiving and guiding a pencil lead into the lead passageway of said slide member.

3. The mechanical pencil of claim 2, wherein said guide means comprises a funnel-shaped surface formed on an inner periphery of the large-diameter portion at a rearmost end thereof.

4. The mechanical pencil of claim 1, wherein said means for preventing rotational movement of said slide member relative to said shell comprises one or more longitudinally extending ribs on an inner surface of said cylindrical shell and one or more longitudinally extending grooves along said slide member, said grooves engaging said ribs to prevent rotational movement of said slide member relative to said cylindrical shell.

5. The mechanical pencil of claim 1, wherein said means for preventing rotational movement of said slide member relative to said shell comprises one or more longitudinally extending ribs on said slide member and one or more longitudinally extending grooves along an inner surface of said cylindrical cell, said grooves engaging said ribs to prevent rotational movement of said slide member relative to said cylindrical shell.

6. The mechanical pencil of claim 1, wherein said cylindrical shell has a grip portion and said knock lever is located longitudinally behind said grip portion.

7. The mechanical pencil of claim 6, further comprising a grip member mounted on said cylindrical shell at said grip portion.

8. The mechanical pencil of claim 1, wherein said chuck member includes a coupling member attached to a rear end thereof, and said slide member is connected to said coupling member in a manner to be axially movable relative to said coupling member.

9. The mechanical pencil of claim 8, wherein said cylindrical shell has a shoulder formed on an inner surface thereof and a gap is provided between a rearmost end of said coupling member and an abutting portion of said slide member to allow limited axial movement of said slide member relative to said coupling member, said pencil further comprising a second biasing member arranged between said shoulder and said slide member to bias said slide member axially away from said coupling member, the second biasing member having a biasing force weaker than that of the first biasing member.

10. The mechanical pencil of claim 8, wherein said lead passageway and said coupling member are sized to permit a plurality of pencil leads to be disposed therein simultaneously.

11. The mechanical pencil of claim 1, wherein said lead passageway is sized to permit a plurality of pencil leads to be disposed therein simultaneously.

12. The mechanical pencil of claim 1, further comprising a cap or eraser mounted to the rear end of the pencil.

* * * * *